US012544628B2

(12) United States Patent
Inoue et al.

(10) Patent No.: US 12,544,628 B2
(45) Date of Patent: Feb. 10, 2026

(54) GOLF BALL

(71) Applicant: Sumitomo Rubber Industries, Ltd., Kobe (JP)

(72) Inventors: Hidetaka Inoue, Kobe (JP); Mariko Hashinokuchi, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 18 days.

(21) Appl. No.: 18/204,987

(22) Filed: Jun. 2, 2023

(65) Prior Publication Data

US 2023/0390610 A1 Dec. 7, 2023

(30) Foreign Application Priority Data

Jun. 3, 2022 (JP) ..... 2022-090976
Jun. 3, 2022 (JP) ..... 2022-090977

(51) Int. Cl.
*A63B 37/06* (2006.01)
*A63B 37/00* (2006.01)

(52) U.S. Cl.
CPC ..... *A63B 37/0063* (2013.01); *A63B 37/0032* (2013.01); *A63B 37/0044* (2013.01); *A63B 37/0074* (2013.01); *A63B 37/0075* (2013.01); *A63B 37/0087* (2013.01); *A63B 37/00922* (2020.08)

(58) Field of Classification Search
CPC ..... A63B 37/0063; A63B 37/00922; A63B 37/0075
See application file for complete search history.

(56) References Cited

U.S. PATENT DOCUMENTS

2012/0010021 A1* 1/2012 Fushihara ..... C08K 5/14 473/372
2016/0175660 A1 6/2016 Watanabe et al.
2020/0206580 A1* 7/2020 Watanabe ..... A63B 37/0019
2021/0106879 A1 4/2021 Watanabe et al.

FOREIGN PATENT DOCUMENTS

JP 2016-112308 A 6/2016
JP 2021-62036 A 4/2021

* cited by examiner

*Primary Examiner* — Raeann Gorden
(74) *Attorney, Agent, or Firm* — Birch, Stewart, Kolasch & Birch, LLP

(57) ABSTRACT

An object of the present disclosure is to provide a golf ball having improved flight distance on driver shots and excellent spin performance on approach shots (particularly under the condition that there is grass between the golf ball and the club face) and on middle iron shots. The present disclosure provides a golf ball comprising a spherical core and a cover disposed outside the spherical core, wherein when a center hardness of the spherical core (Shore C hardness), hardnesses at 2.5 mm, 5 mm, 7.5 mm, 10 mm, 12.5 mm and 15 mm points from a center of the spherical core toward a surface of the spherical core (Shore C hardness), and a surface hardness of the spherical core (Shore C hardness) are represented by $H_0$, $H_{2.5}$, $H_5$, $H_{7.5}$, $H_{10}$, $H_{12.5}$, $H_{15}$ and $H_s$ respectively, the following relation is satisfied:

$$(H_{2.5}-H_{10})>(H_{12.5}-H_{10})>(H_s-H_{15}).$$

20 Claims, 1 Drawing Sheet

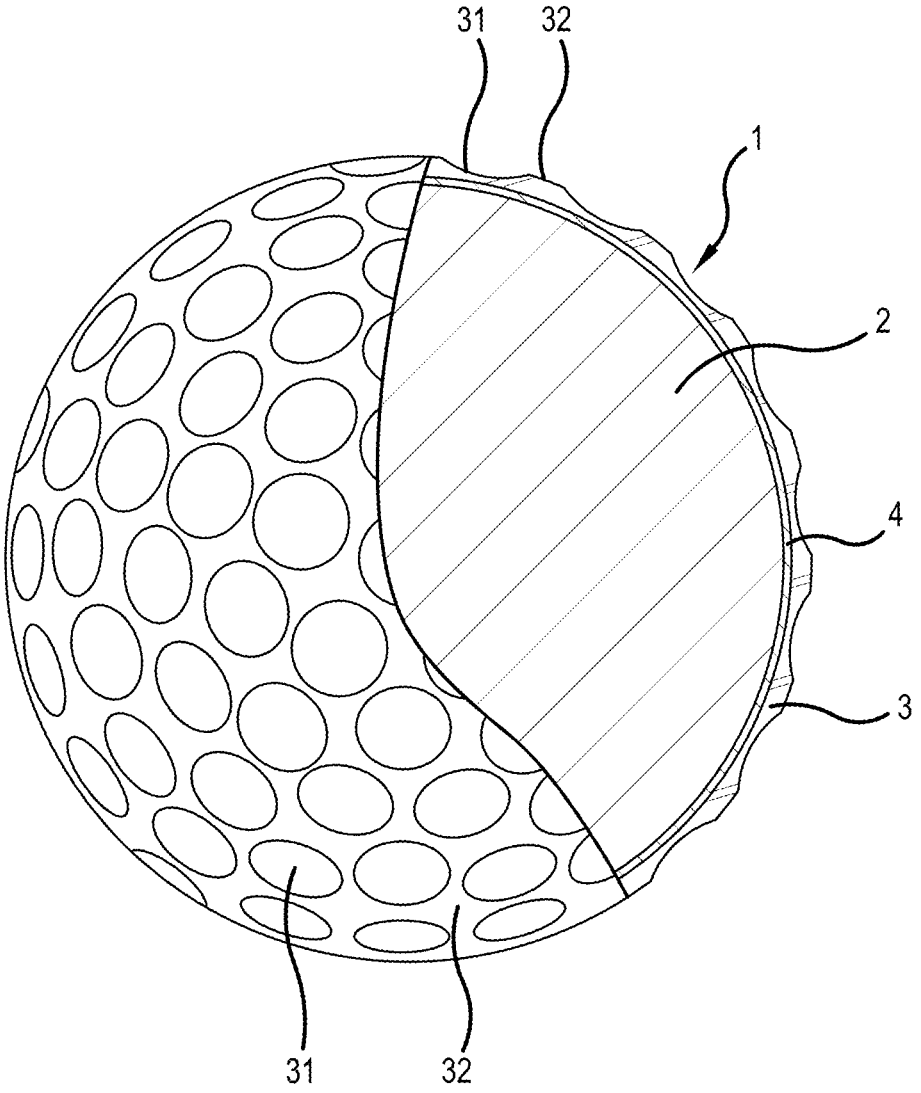
31
32
1
2
4
3
31
32

GOLF BALL

FIELD OF THE INVENTION

The present disclosure relates to a golf ball, and particularly relates to a technology for improving a core hardness distribution.

DESCRIPTION OF THE RELATED ART

In order to increase a flight distance on driver shots, various investigations have been made. For example, there is a technology of increasing a flight distance on driver shots by increasing a hardness difference between a surface and a center of a core and lowering a spin rate. Further, in addition to the flight distance on driver shots, good flight distance on middle iron shots or good spin performance on approach shots is also required. Examples of such technology include JP 2021-62036 A and JP 2016-112308 A.

JP 2021-62036 A discloses a multi-piece solid golf ball comprising a core, an intermediate layer and a cover, wherein the core is formed primarily of a base rubber and has a diameter of at least 32 mm, the intermediate layer and the cover are each formed of a resin material, the core has an internal hardness which is such that, letting Cc be the Shore C hardness at a center of the core, C2 be the Shore C hardness at a position 2 mm from the core center, C4 be the Shore C hardness at a position 4 mm from the core center, C6 be the Shore C hardness at a position 6 mm from the core center, C8 be the Shore C hardness at a position 8 mm from the core center, C10 be the Shore C hardness at a position 10 mm from the core center, C12 be the Shore C hardness at a position 12 mm from the core center, C14 be the Shore C hardness at a position 14 mm from the core center, C16 be the Shore C hardness at a position 16 mm from the core center, Cs be the Shore C hardness at a surface of the core, Cs-3 be the Shore C hardness at a position 3 mm inside the core surface, and Cm be the Shore C hardness at a position midway between the core surface and the core center, the values of C8-C6, C6-C4, C4-C2 and C2-Cc are all 4.0 or less and the values of C16-C14, C14-C12, C12-C10 and C10-C8 are all 5.5 or less, and which satisfies formulae (1), (2) and (3) below, and the sphere obtained by encasing the core with the intermediate layer (intermediate layer-encased sphere) has a Shore C surface hardness and the ball has a Shore C surface hardness which satisfy formula (4) below.

$$Cs-Cc \geq 22 \quad (1)$$

$$(Cs-Cm)/(C4-Cc) \geq 4.0 \quad (2)$$

$$CsCs-3 \leq 5.0 \quad (3)$$

surface hardness of golf ball<surface hardness of intermediate layer-encased sphere (4)

JP 2016-112308 A discloses a multi-piece solid golf ball comprising a core, a cover, and an intermediate layer therebetween, wherein the core, a sphere composed of the core and the intermediate layer which peripherally encases the core (intermediate layer-encased sphere), and the ball have respective surface hardnesses, expressed in terms of Shore D hardness, which satisfy the relationship of ball surface hardness≤surface hardness of intermediate layer-encased sphere≥core surface hardness, the intermediate layer and the cover have respective thicknesses which satisfy the relationship of (thickness of intermediate layer−thickness of cover) ≥0, and the core has a hardness profile which, expressed in terms of JIS-C hardness, satisfies the relationships of 22≤score surface hardness (Cs)−core center hardness (Cc), 5> [hardness at a position 5 mm from core center (C5)−core center hardness (Cc)]>0, and [core surface hardness (Cs)−core center hardness (Cc)]/[hardness at a position midway between core surface and core center (Cm)−core center hardness (Cc)]≥4.

SUMMARY OF THE INVENTION

A professional golfer and a highly skilled golfer request to increase the spin rate on middle iron shots. However, if the spin rate on driver shots is lowered to increase the flight distance, the spin rate on middle iron shots also decreases. In addition, a professional golfer and a highly skilled golfer request to increase the spin rate on approach shots under the condition that there is grass between the golf ball and the club face.

The present disclosure has been made in view of the abovementioned circumstances, and an object of the present disclosure is to provide a golf ball having an improved flight distance on driver shots and excellent spin performance on approach shots (particularly under the condition that there is grass between the golf ball and the club face) and on middle iron shots.

The present disclosure provides a golf ball comprising a spherical core and a cover disposed outside the spherical core, wherein when a center hardness of the spherical core (Shore C hardness), hardnesses at 2.5 mm, 5 mm, 7.5 mm, 10 mm, 12.5 mm and 15 mm points from a center of the spherical core toward a surface of the spherical core (Shore C hardness), and a surface hardness of the spherical core (Shore C hardness) are represented by $H_0$, $H_{2.5}$, $H_5$, $H_{7.5}$, $H_{10}$, $H_{12.5}$, $H_{15}$ and $H_s$ respectively, the following relation is satisfied:

$$(H_{2.5}-H_0)>(H_{12.5}-H_{10})>(H_s-H_{15}).$$

According to the present disclosure, a golf ball having an improved flight distance on driver shots and excellent spin performance on approach shots (particularly under the condition that there is grass between the golf ball and the club face) and on middle iron shots is provided.

BRIEF DESCRIPTION OF THE DRAWINGS

The FIGURE is a partially cutaway cross-sectional view of a golf ball according to one embodiment of the present disclosure.

DESCRIPTION OF THE PREFERRED EMBODIMENT

The present disclosure provides a golf ball comprising a spherical core and a cover disposed outside the spherical core, wherein when a center hardness of the spherical core (Shore C hardness), hardnesses at 2.5 mm, 5 mm, 7.5 mm, 10 mm, 12.5 mm and 15 mm points from a center of the spherical core toward a surface of the spherical core (Shore C hardness), and a surface hardness of the spherical core (Shore C hardness) are represented by $H_0$, $H_{2.5}$, $H_5$, $H_{7.5}$, $H_{10}$, $H_{12.5}$, $H_{15}$ and $H_s$ respectively, the following relation is satisfied:

$$(H_{2.5}-H_0)>(H_{12.5}-H_{10})>(H_s-H_{15}).$$

If the golf ball according to the present disclosure is configurated as above, the initial velocity on driver shots is high, and the spin rates on approach shots (particularly under the condition that there is grass between the golf ball and the club face) and on middle iron shots are high. As a result, the flight distance on driver shots is great, and the spin performance on approach shots and on middle iron shots improves.

The spherical core is cut along a cross-section passing through the central point of the spherical core to provide a cut plane. The center hardness of the spherical core (Shore C hardness) and the hardnesses at 2.5 mm, 5 mm, 7.5 mm, 10 mm, 12.5 mm and 15 mm points from the center of the spherical core toward the surface of the spherical core (Shore C hardness) are respectively a hardness measured at a central point of the cut plane and hardnesses measured at points located at predetermined distances from the central point of the cut plane. The surface hardness of the spherical core is a hardness measured on the surface of the spherical core.

In the present disclosure, the spherical core satisfies the relation of $(H_{2.5}-H_0)>(H_{12.5}-H_{10})$.

The difference $((H_{2.5}-H_0)-(H_{12.5}-H_{10}))$ between the hardness difference $(H_{2.5}-H_0)$ and the hardness difference $(H_{12.5}-H_{10})$ is preferably more than 0, more preferably 0.5 or more, and even more preferably 1 or more in Shore C hardness, and is preferably 5 or less, more preferably 4.5 or less, and even more preferably 4 or less in Shore C hardness. If the difference $((H_{2.5}-H_0)-(H_{12.5}-H_{10}))$ falls within the above range, the initial velocity of the ball on driver shots, and the spin rate of the ball on approach shots (particularly under the condition that there is grass between the golf ball and the club face) and on middle iron shots become higher.

In the present disclosure, the spherical core satisfies the relation of $(H_{12.5}-H_{10})>(H_s-H_{15})$.

The difference $((H_{12.5}-H_{10})-(H_s-H_{15}))$ between the hardness difference $(H_{12.5}-H_{10})$ and the hardness difference $(H_s-H_{15})$ is preferably more than 0, more preferably 0.5 or more, and even more preferably 1 or more in Shore C hardness, and is preferably 5 or less, more preferably 4 or less, and even more preferably 3 or less in Shore C hardness. If the difference $((H_{12.5}-H_{10})-(H_s-H_{15}))$ falls within the above range, the initial velocity of the ball on driver shots, and the spin rate of the ball on approach shots (particularly under the condition that there is grass between the golf ball and the club face) and on middle iron shots become higher.

In the present disclosure, the spherical core preferably satisfies the relation of $(H_{10}-H_0)\geq 7$.

The hardness difference $(H_{10}-H_0)$ is preferably 7 or more, more preferably 8 or more, and even more preferably 9 or more in Shore C hardness. If the hardness difference $(H_{10}-H_0)$ is 7 or more in Shore C hardness, the initial velocity of the golf ball on driver shots becomes higher. In addition, the hardness difference $(H_{10}-H_0)$ is not particularly limited, and is preferably 20 or less, more preferably 18 or less, and even more preferably 16 or less in Shore C hardness.

In the present disclosure, the spherical core preferably satisfies the relation of $0\leq(H_s-H_{15})\leq 5$.

The hardness difference $(H_s-H_{15})$ is preferably 5 or less, more preferably 4.5 or less, and even more preferably 4 or less in Shore C hardness. If the hardness difference $(H_s-H_{15})$ is 5 or less in Shore C hardness, the spin rate on approach shots (particularly under the condition that there is grass between the golf ball and the club face) and on middle iron shots become higher. In addition, the hardness difference $(H_s-H_{15})$ is not particularly limited, and is preferably 0 or more, more preferably 0.5 or more, and even more preferably 1 or more in Shore C hardness.

The average hardness $((H_{2.5}+H_5+H_{7.5}+H_{10})/4)$ of the hardness at 2.5 mm point from the center of the spherical core $(H_{2.5})$, the hardness at 5 mm point from the center of the spherical core $(H_5)$, the hardness at 7.5 mm point from the center of the spherical core $(H_{7.5})$ and the hardness at 10 mm point from the center of the spherical core $(H_{10})$ is preferably 70 or more, more preferably 71 or more, and even more preferably 72 or more in Shore C hardness, and is preferably 80 or less, more preferably 79 or less, and even more preferably 78 or less in Shore C hardness. If the average hardness falls within the above range, the initial velocity of the golf ball on driver shots becomes higher, and increase in the spin rate on driver shots is suppressed.

The average hardness $((H_{15}+H_s)/2)$ of the hardness at 15 mm point from the center of the spherical core $(H_{15})$ and the surface hardness of the spherical core $(H_s)$ is preferably 75 or more, more preferably 76 or more, and even more preferably 77 or more in Shore C hardness, and is preferably 85 or less, more preferably 84 or less, and even more preferably 83 or less in Shore C hardness. If the average hardness falls within the above range, the spin rate on middle iron shots becomes higher, and the durability is better.

The hardness difference $(H_{2.5}-H_0)$ is preferably 5 or more, more preferably 5.5 or more, and even more preferably 6 or more in Shore C hardness. In addition, the upper limit of the hardness difference $(H_{2.5}-H_0)$ is not particularly limited, and the hardness difference $(H_{2.5}-H_0)$ is preferably 11 or less, more preferably 10 or less, and even more preferably 9 or less in Shore C hardness. If the hardness difference $(H_{2.5}-H_0)$ falls within the above range, the initial velocity of the golf ball on driver shots becomes higher.

The hardness difference $(H_{12.5}-H_{10})$ is preferably 2 or more, more preferably 2.5 or more, and even more preferably 3 or more in Shore C hardness, and is preferably 7 or less, more preferably 6 or less, and even more preferably 5 or less in Shore C hardness. If the hardness difference $(H_{12.5}-H_{10})$ falls within the above range, the spin rate on middle iron shots becomes higher.

The ratio $((H_{10}-H_0)/(H_s-H_{15}))$ of the hardness difference $(H_{10}-H_0)$ to the hardness difference $(H_s-H_{15})$ is preferably 2 or more, more preferably 3 or more, and even more preferably 4 or more, and is preferably 12 or less, more preferably 11 or less, and even more preferably 10 or less. If the ratio $((H_{10}-H_0)/(H_s-H_{15}))$ of the hardness difference $(H_{10}-H_0)$ to the hardness difference $(H_s-H_{15})$ falls within the above range, the spin rate on middle iron shots becomes higher.

The hardness difference $(H_s-H_0)$ between the surface hardness $(H_s)$ and the center hardness $(H_0)$ of the spherical core is preferably 15 or more, more preferably 16 or more, and even more preferably 17 or more in Shore C hardness, and is preferably 25 or less, more preferably 22 or less, and even more preferably 20 or less in Shore C hardness. If the hardness difference $(H_s-H_0)$ falls within the above range, the spin rate on driver shots is suppressed, and thus the flight distance further increases.

The hardness difference $(H_5-H_{2.5})$ between the hardness $(H_5)$ at 5 mm point from the center of the spherical core and the hardness $(H_{2.5})$ at 2.5 mm point from the center of the spherical core is preferably 3 or less, more preferably 2.5 or less, and even more preferably 2 or less in Shore C hardness, and is preferably 0 or more, more preferably 0.5 or more, and even more preferably 1 or more in Shore C hardness. If the hardness difference $(H_5-H_{2.5})$ falls within the above range, the initial velocity of the golf ball on driver shots becomes higher.

The hardness difference $(H_{7.5}-H_5)$ between the hardness $(H_{7.5})$ at 7.5 mm point from the center of the spherical core and the hardness $(H_5)$ at 5 mm point from the center of the spherical core is preferably 3 or less, more preferably 2.5 or less, and even more preferably 2 or less in Shore C hardness, and is preferably 0 or more, more preferably 0.5 or more, and even more preferably 1 or more in Shore C hardness. If the hardness difference ($H_{7.5}-H_5$) falls within the above range, the initial velocity of the golf ball on driver shots becomes higher.

The hardness difference ($H_{10}-H_{7.5}$) between the hardness ($H_{10}$) at 10 mm point from the center of the spherical core and the hardness ($H_{7.5}$) at 7.5 mm point from the center of the spherical core is preferably 3 or less, more preferably 2.5 or less, and even more preferably 2 or less in Shore C hardness, and is preferably 0 or more, more preferably 0.5 or more, and even more preferably 1 or more in Shore C hardness. If the hardness difference ($H_{10}-H_{7.5}$) falls within the above range, the initial velocity of the golf ball on driver shots becomes higher, and the shot feeling of the golf ball on driver shots is softer and better.

The hardness difference ($H_{15}-H_{12.5}$) between the hardness ($H_{15}$) at 15 mm point from the center of the spherical core and the hardness ($H_{12.5}$) at 12.5 mm point from the center of the spherical core is preferably 7 or less, more preferably 6 or less, and even more preferably 5 or less in Shore C hardness, and is preferably more than 0, more preferably 0.5 or more, and even more preferably 1 or more in Shore C hardness. If the hardness difference ($H_{15}-H_{12.5}$) falls within the above range, the spin rate on middle iron shots becomes higher, and the shot feeling is softer and better.

The surface hardness ($H_s$) of the spherical core is not particularly limited, and is preferably 75 or more, more preferably 76 or more, more preferably 77 or more in Shore C hardness, and is preferably 85 or less, more preferably 84 or less, and even more preferably 83 or less in Shore C hardness. If the surface hardness ($H_s$) falls within the above range, the shot feeling on approach shots is softer and the durability is better.

The center hardness ($H_0$) of the spherical core is not particularly limited, and is preferably 60 or more, more preferably 61 or more, and even more preferably 62 or more in Shore C hardness, and is preferably 72 or less, more preferably 71 or less, and even more preferably 70 or less in Shore C hardness. If the center hardness ($H_0$) of the spherical core falls within the above range, the initial velocity of the golf ball on driver shots becomes higher, and the spin rate is suppressed.

In a preferable embodiment according to the present disclosure, the spherical core satisfies the following relations.

$$(H_{2.5}-H_0)>(H_{12.5}-H_{10})>(H_s-H_{15})$$

$$(H_{10}-H_0)\geq 7$$

$$0\leq(H_s-H_{15})\leq 5$$

In another preferable embodiment according to the present disclosure, the spherical core satisfies the following relations.

$$(H_{2.5}-H_0)>(H_{12.5}-H_{10})>(H_s-H_{15})$$

$$(H_{2.5}+H_5+H_{7.5}+H_{10})/4\geq 70$$

$$75\leq(H_{15}+H_s)/2\leq 85$$

The spherical core of the golf ball according to the present disclosure is preferably formed from a rubber composition (hereinafter sometimes referred to as "core rubber composition") containing (a) a base rubber, (b) an α,β-unsaturated carboxylic acid having 3 to 8 carbon atoms and/or a metal salt thereof as a co-crosslinking agent, and (c) a crosslinking initiator.

As (a) the base rubber, a natural rubber and/or a synthetic rubber is used, for example, a polybutadiene rubber, a natural rubber, a polyisoprene rubber, a styrene-polybutadiene rubber, or an ethylene-propylene-diene rubber (EPDM) is used.

These rubbers may be used solely, or two or more of them may be used in combination. Among them, a high-cis polybutadiene having a cis-1,4 bond in an amount of 40 mass % or more, preferably 80 mass % or more, and more preferably 90 mass % or more in view of its superior resilience, is particularly suitable.

The amount of the 1,2-vinyl bond in the high-cis polybutadiene is preferably 2.0 mass % or less, more preferably 1.7 mass % or less, and even more preferably 1.5 mass % or less. If the amount of the 1,2-vinyl bond is 2.0 mass % or less, the resilience is better.

The high-cis polybutadiene is preferably a polybutadiene synthesized using a rare earth element catalyst. When a neodymium catalyst, which employs a neodymium compound that is a lanthanum series rare earth element compound, is used, a polybutadiene rubber having a high amount of the cis-1,4 bond and a low amount of the 1,2-vinyl bond is obtained with excellent polymerization activity. Such a polybutadiene rubber is particularly preferable.

The Mooney viscosity ($ML_{1+4}$ (100° C.)) of the high-cis polybutadiene is preferably 30 or more, more preferably 32 or more, and even more preferably 35 or more, and is preferably 140 or less, more preferably 120 or less, even more preferably 100 or less, and most preferably 80 or less. It is noted that the Mooney viscosity ($ML_{1+4}$ (100° C.)) in the present disclosure is a value measured according to JIS K6300 using an L rotor under the conditions of: a preheating time of 1 minute; a rotor revolution time of 4 minutes; and a temperature of 100° C.

The molecular weight distribution Mw/Mn (Mw: weight average molecular weight, Mn: number average molecular weight) of the high-cis polybutadiene is preferably 2.0 or more, more preferably 2.2 or more, even more preferably 2.4 or more, and most preferably 2.6 or more, and is preferably 6.0 or less, more preferably 5.0 or less, even more preferably 4.0 or less, and most preferably 3.4 or less. If the molecular weight distribution (Mw/Mn) of the high-cis polybutadiene is 2.0 or more, the processability is better, and if the molecular weight distribution (Mw/Mn) of the high-cis polybutadiene is 6.0 or less, the resilience is greater. It is noted that the measurement of the molecular weight distribution is conducted by gel permeation chromatography ("HLC-8120GPC", available from Tosoh Corporation) using a differential refractometer as a detector under the conditions of column: GMHHXL (available from Tosoh Corporation), column temperature: 40° C., and mobile phase: tetrahydrofuran, and calculated by converting based on polystyrene standard.

(b) The α,β-unsaturated carboxylic acid having 3 to 8 carbon atoms and/or the metal salt thereof is added as a co-crosslinking agent in the rubber composition, and has an action of crosslinking the rubber molecule by graft polymerization to the base rubber molecular chain.

Examples of the α, β-unsaturated carboxylic acid having 3 to 8 carbon atoms include acrylic acid, methacrylic acid, fumaric acid, maleic acid and crotonic acid.

Examples of the metal component constituting the metal salt of the α,β-unsaturated carboxylic acid having 3 to 8 carbon atoms include a monovalent metal ion such as sodium, potassium and lithium; a divalent metal ion such as magnesium, calcium, zinc, barium and cadmium; a trivalent metal ion such as aluminum; and other metal ion such as tin and zirconium. These metal components may be used solely or as a mixture of at least two of them. Among them, the divalent metal ion such as magnesium, calcium, zinc, barium or cadmium is preferably used as the metal component. This is because if the divalent metal salt of the α,β-unsaturated carboxylic acid having 3 to 8 carbon atoms is used, a metal crosslinking easily generates between the rubber molecules. Especially, the divalent metal salt is preferably zinc acrylate because use of such divalent metal salt enhances the resilience of the obtained golf ball. It is noted that the α,β-unsaturated carboxylic acid having 3 to 8 carbon atoms and/or the metal salt thereof may be used solely, or two or more of them may be used in combination.

The amount of (b) the α, β-unsaturated carboxylic acid having 3 to 8 carbon atoms and/or the metal salt thereof is preferably 15 parts by mass or more, more preferably 20 parts by mass or more, and even more preferably 25 parts by mass or more, and is preferably 50 parts by mass or less, more preferably 40 parts by mass or less, and even more preferably 30 parts by mass or less, with respect to 100 parts by mass of (a) the base rubber. If the amount of (b) the α, β-unsaturated carboxylic acid having 3 to 8 carbon atoms and/or the metal salt thereof is 15 parts by mass or more, the resultant core has a more appropriate hardness and thus the resilience of the golf ball is better. On the other hand, if the amount of (b) the α,β-unsaturated carboxylic acid having 3 to 8 carbon atoms and/or the metal salt thereof is 50 parts by mass or less, the resultant core is not excessively hard and thus the shot feeling of the golf ball is better.

(c) The crosslinking initiator is added to crosslink (a) the base rubber component. As (c) the crosslinking initiator, an organic peroxide is suitable. Specific examples of the organic peroxide include dicumyl peroxide, 1,1-bis(t-butylperoxy)-3,3,5-trimethylcyclohexane, 2,5-dimethyl-2,5-di(t-butylperoxy) hexane and di-t-butyl peroxide. These organic peroxides may be used solely or as a mixture of at least two of them. Among them, dicumyl peroxide is preferably used.

The amount of (c) the crosslinking initiator is preferably 0.2 part by mass or more, more preferably 0.4 part by mass or more, and even more preferably 0.6 part by mass or more, and is preferably 5.0 parts by mass or less, more preferably 2.5 parts by mass or less, and even more preferably 1.0 part by mass or less, with respect to 100 parts by mass of (a) the base rubber. If the amount of (c) the crosslinking initiator falls within the above range, the resultant core has a more appropriate hardness and thus the resilience of the golf ball is better.

In the case that the rubber composition contains only the α,β-unsaturated carboxylic acid having 3 to 8 carbon atoms as the co-crosslinking agent, the rubber composition preferably further contains (d) a metal compound. This is because neutralizing the α, β-unsaturated carboxylic acid having 3 to 8 carbon atoms with the metal compound in the rubber composition provides substantially the same effect as using the metal salt of the α, β-unsaturated carboxylic acid having 3 to 8 carbon atoms as the co-crosslinking agent. In addition, in case of using the α, β-unsaturated carboxylic acid having 3 to 8 carbon atoms and the metal salt thereof in combination as the co-crosslinking agent, (d) the metal compound may also be used.

(d) The metal compound is not particularly limited, as long as the metal compound neutralizes (b) the α,β-unsaturated carboxylic acid having 3 to 8 carbon atoms in the rubber composition. Examples of (d) the metal compound include a metal hydroxide such as magnesium hydroxide, zinc hydroxide, calcium hydroxide, sodium hydroxide, lithium hydroxide, potassium hydroxide, and copper hydroxide; a metal oxide such as magnesium oxide, calcium oxide, zinc oxide, and copper oxide; and a metal carbonate such as magnesium carbonate, zinc carbonate, calcium carbonate, sodium carbonate, lithium carbonate, and potassium carbonate. (d) The metal compound is preferably a divalent metal compound, more preferably a zinc compound. This is because the divalent metal compound reacts with the α, β-unsaturated carboxylic acid having 3 to 8 carbon atoms, thereby forming a metal crosslinking. Further, use of the zinc compound provides a golf ball with higher resilience. (d) The metal compound may be used solely, or two or more of them may be used in combination.

The rubber composition preferably further contains (e) an organic sulfur compound. (e) The organic sulfur compound is not particularly limited, as long as it is an organic compound having a sulfur atom in the molecule thereof. Examples thereof include an organic compound having a thiol group (—SH) or a polysulfide bond having 2 to 4 sulfur atoms (—S—S—, —S—S—S—, or —S—S—S—S—), and a metal salt thereof (—SM, —S—M—S—, or the like; M is a metal atom). Examples of (e) the organic sulfur compound include thiophenols, thionaphthols, polysulfides, thiurams, thiocarboxylic acids, dithiocarboxylic acids, sulfenamides, dithiocarbamates, and thiazoles.

Examples of the thiophenols include thiophenol; thiophenols substituted with a fluoro group, such as 4-fluorothiophenol, 2,4-difluorothiophenol, 2,5-difluorothiophenol, 2,6-difluorothiophenol, 2,4,5-trifluorothiophenol, and 2,4,5,6-tetrafluorothiophenol, pentafluorothiophenol; thiophenols substituted with a chloro group, such as 2-chlorothiophenol, 4-chlorothiophenol, 2,4-dichlorothiophenol, 2,5-dichlorothiophenol, 2,6-dichlorothiophenol, 2,4,5-trichlorothiophenol, 2,4,5,6-tetrachlorothiophenol, and pentachlorothiophenol; thiophenols substituted with a bromo group, such as 4-bromothiophenol, 2,4-dibromothiophenol, 2,5-dibromothiophenol, 2,6-dibromothiophenol, 2,4,5-tribromothiophenol, 2,4,5,6-tetrabromothiophenol, and pentabromothiophenol; thiophenols substituted with an iodo group, such as 4-iodothiophenol, 2,4-diiodothiophenol, 2,5-diiodothiophenol, 2,6-diiodothiophenol, 2,4,5-triiodothiophenol, and 2,4,5,6-tetraiodothiophenol, pentaiodothiophenol; and metal salts thereof.

Examples of the thionaphthols (naphthalenethiols) include 2-thionaphthol, 1-thionaphthol, 1-chloro-2-thionaphthol, 2-chloro-1-thionaphthol, 1-bromo-2-thionaphthol, 2-bromo-1-thionaphthol, 1-fluoro-2-thionaphthol, 2-fluoro-1-thionaphthol, 1-cyano-2-thionaphthol, 2-cyano-1-thionaphthol, 1-acetyl-2-thionaphthol, 2-acetyl-1-thionaphthol, and a metal salt thereof.

The polysulfides are organic sulfur compounds having a polysulfide bond, and examples thereof include disulfides, trisulfides, and tetrasulfides. As the polysulfides, diphenylpolysulfides are preferable.

Examples of the diphenylpolysulfides include diphenyldisulfide; diphenyldisulfides substituted with a halogen group, such as bis(4-fluorophenyl)disulfide, bis(2,5-difluorophenyl)disulfide, bis(2,6-difluorophenyl)disulfide, bis(2,4,5-trifluorophenyl)disulfide, bis(2,4,5,6-tetrafluorophenyl)disulfide, bis(pentafluorophenyl)disulfide, bis(4-chlorophenyl)disulfide, bis(2,5-dichlorophenyl)disulfide, bis(2,6-dichlorophenyl)disulfide, bis(2,4,5-trichlorophenyl)disulfide, bis(2,4,5,6-tetrachlorophenyl)disulfide, bis(pentachlorophenyl)disulfide, bis(4-bromophenyl)disulfide, bis (2,5-dibromophenyl)disulfide, bis(2,6-dibromophenyl) disulfide, bis(2,4,5-tribromophenyl)disulfide, bis(2,4,5,6-tetrabromophenyl)disulfide, bis(pentabromophenyl) disulfide, bis(4-iodophenyl)disulfide, bis(2,5-diiodophenyl) disulfide, bis(2,6-diiodophenyl)disulfide, bis(2,4,5-triiodophenyl)disulfide, bis(2,4,5,6-tetraiodophenyl) disulfide, and bis(pentaiodophenyl)disulfide; and diphenyldisulfides substituted with an alkyl group, such as bis(4-methylphenyl)disulfide, bis(2,4,5-trimethylphenyl) disulfide, bis(pentamethylphenyl)disulfide, bis(4-t-butylphenyl)disulfide, bis(2,4,5-tri-t-butylphenyl)disulfide, and bis(penta-t-butylphenyl)disulfide.

Examples of the thiurams include thiuram monosulfides such as tetramethylthiuram monosulfide; thiuram disulfides such as tetramethylthiuram disulfide, tetraethylthiuram disulfide, and tetrabutylthiuram disulfide; and thiuram tetrasulfides such as dipentamethylenethiuram tetrasulfide. Examples of the thiocarboxylic acids include a naphthalene thiocarboxylic acid. Examples of the dithiocarboxylic acids include a naphthalene dithiocarboxylic acid. Examples of the sulfenamides include N-cyclohexyl-2-benzothiazole sulfenamide, N-oxydiethylene-2-benzothiazole sulfenamide, and N-t-butyl-2-benzothiazole sulfenamide.

(e) The organic sulfur compound may be used solely or in combination of at least two of them.

The amount of (e) the organic sulfur compound is preferably 0.05 part by mass or more, more preferably 0.1 part by mass or more, and even more preferably 0.2 part by mass or more, and is preferably 5.0 parts by mass or less, more preferably 3.0 parts by mass or less, and even more preferably 2.0 parts by mass or less, with respect to 100 parts by mass of (a) the base rubber. If the amount of (e) the organic sulfur compound falls within the above range, the resilience is better.

The rubber composition may further contain (f) a carboxylic acid and/or a metal salt thereof. As (f) the carboxylic acid and/or the metal salt thereof, a carboxylic acid having 1 to 30 carbon atoms and/or a metal salt thereof is preferable. As the carboxylic acid, an aliphatic carboxylic acid (a saturated fatty acid or unsaturated fatty acid) or an aromatic carboxylic acid (such as benzoic acid) is used. The amount of (f) the carboxylic acid and/or the metal salt thereof is preferably 1 part by mass or more and 40 parts by mass or less with respect to 100 parts by mass of (a) the base rubber.

The rubber composition may further contain additives such as a filler for adjusting a weight or the like, an antioxidant, a peptizing agent, a softening agent or the like, where necessary.

The filler blended in the rubber composition is used as a weight adjusting agent for mainly adjusting the weight of the golf ball obtained as a final product. The filler may be blended where necessary. Examples of the filler include an inorganic filler such as zinc oxide, barium sulfate, calcium carbonate, magnesium oxide, tungsten powder, and molybdenum powder. The amount of the filler is preferably 0.5 part by mass or more, more preferably 1 part by mass or more, and is preferably 30 parts by mass or less, more preferably 25 parts by mass or less, and even more preferably 20 parts by mass or less, with respect to 100 parts by mass of (a) the base rubber. If the amount of the filler is 0.5 part by mass or more, it is easier to adjust the weight, and if the amount of the filler is 30 parts by mass or less, the weight ratio of the rubber component is greater and thus the resilience tends to be higher.

The amount of the antioxidant is preferably 0.1 part by mass or more and 1 part by mass or less with respect to 100 parts by mass of (a) the base rubber. In addition, the amount of the peptizing agent is preferably 0.1 part by mass or more and 5 parts by mass or less with respect to 100 parts by mass of (a) the base rubber.

The rubber composition is obtained by kneading (a) the base rubber, (b) the α,β-unsaturated carboxylic acid having 3 to 8 carbon atoms and/or the metal salt thereof, (c) the crosslinking initiator, and other optional components to be added where necessary. The kneading method is not particularly limited. For example, the kneading is conducted by using a conventional kneading machine such as a kneading roll, a banbury mixer, and a kneader.

The spherical core is obtained by vulcanizing (heat pressing) the kneaded rubber composition in a mold. The vulcanization is preferably conducted in two steps in order to easily satisfy the above-described core hardness requirements, more preferably conducted under the following conditions.

In the first step, the vulcanizing temperature is preferably 120° C. or more, more preferably 125° C. or more, and even more preferably 130° C. or more, and is preferably 160° C. or less, more preferably 155° C. or less, and even more preferably 150° C. or less. The vulcanizing time is preferably 5 minutes or more, more preferably 6 minutes or more, and even more preferably 7 minutes or more, and is preferably less than 20 minutes, more preferably 18 minutes or less, and even more preferably 15 minutes or less.

In the second step, the vulcanizing temperature is preferably 130° C. or more, more preferably 135° C. or more, and even more preferably 140° C. or more, and is preferably 170° C. or less, more preferably 165° C. or less, and even more preferably 160° C. or less. The vulcanizing time is preferably 5 minutes or more, more preferably 6 minutes or more, and even more preferably 7 minutes or more, and is preferably 20 minutes or less, more preferably 18 minutes or less, and even more preferably 15 minutes or less.

The difference between the vulcanizing temperature in the second step and the vulcanizing temperature in the first step (vulcanizing temperature in the second step—vulcanizing temperature in the first step) is preferably 2° C. or more, more preferably 3° C. or more, and even more preferably 4° C. or more, and is preferably 20° C. or less, more preferably 18° C. or less, and even more preferably 16° C. or less. The spherical core may be single-layered or multiple-layered, and is preferably single layered.

The diameter of the spherical core is preferably 34.8 mm or more, more preferably 36.8 mm or more, and even more preferably 38.8 mm or more, and is preferably 42.2 mm or less, more preferably 41.8 mm or less, even more preferably 41.2 mm or less, and most preferably 40.8 mm or less. If the diameter of the spherical core is 34.8 mm or more, the cover is not excessively thick, and thus the resilience is better. On the other hand, if the diameter of the spherical core is 42.2 mm or less, the cover is not excessively thin, and thus the cover functions better.

When the spherical core has a diameter in the range from 34.8 mm to 42.2 mm, the compression deformation amount of the core (shrinking amount of the core along the compression direction) when applying a load from an initial load of 98 N to a final load of 1275 N is preferably 2.0 mm or more, more preferably 2.5 mm or more, and even more preferably 3.0 mm or more, and is preferably 5.0 mm or less, more preferably 4.5 mm or less, and even more preferably 4.0 mm or less. If the compression deformation amount is 2.0 mm or more, the shot feeling is better, and if the compression deformation amount is 5.0 mm or less, the resilience is better.

The golf ball according to the present disclosure comprises a cover disposed outside the core. The cover is preferably formed from a resin composition containing a resin component. Examples of the resin component include an ionomer resin, a thermoplastic polyurethane elastomer having a trade name of "Elastollan (registered trademark)" available from BASF Japan Ltd., a thermoplastic polyamide elastomer having a trade name of "Pebax (registered trademark)" available from Arkema K. K., a thermoplastic polyester elastomer having a trade name of "Hytrel (registered trademark)" available from Du Pont-Toray Co., Ltd., and a thermoplastic styrene elastomer having a trade name of "Tefabloc" available from Mitsubishi Chemical Corporation.

Examples of the ionomer resin include a product obtained by neutralizing at least a part of carboxyl groups in a binary copolymer composed of an olefin and an α,β-unsaturated carboxylic acid having 3 to 8 carbon atoms with a metal ion; a product obtained by neutralizing at least a part of carboxyl groups in a ternary copolymer composed of an olefin, an α,β-unsaturated carboxylic acid having 3 to 8 carbon atoms and an α, β-unsaturated carboxylic acid ester with a metal ion; and a mixture thereof. The olefin is preferably an olefin having 2 to 8 carbon atoms. Examples of the olefin include ethylene, propylene, butene, pentene, hexene, heptene and octene, and ethylene is particularly preferable. Examples of the α, β-unsaturated carboxylic acid having 3 to 8 carbon atoms include acrylic acid, methacrylic acid, fumaric acid, maleic acid and crotonic acid, and acrylic acid or methacrylic acid is particularly preferable. In addition, examples of the α,β-unsaturated carboxylic acid ester include a methyl ester, an ethyl ester, a propyl ester, a n-butyl ester, an isobutyl ester of acrylic acid, methacrylic acid, fumaric acid and maleic acid, and an acrylic acid ester or a methacrylic acid ester is particularly preferable. Among them, as the ionomer resin, a metal ion neutralized product of ethylene-(meth)acrylic acid binary copolymer or a metal ion neutralized product of ethylene-(meth)acrylic acid-(meth)acrylic acid ester ternary copolymer is preferable.

Specific examples of the ionomer resin include "Himilan (registered trademark) (e.g. binary copolymer ionomer resins such as Himilan 1555 (Na), Himilan 1557 (Zn), Himilan 1605 (Na), Himilan 1706 (Zn), Himilan 1707 (Na), Himilan AM7311 (Mg), and Himilan AM7329 (Zn)); and ternary copolymer ionomer resins such as Himilan 1856 (Na) and Himilan 1855 (Zn))" available from Mitsui-Du Pont Polychemicals Co., Ltd.

Specific examples of the ionomer resin further include "Surlyn (registered trademark) (e.g. binary copolymer ionomer resins such as Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), and Surlyn AD8546 (Li)); and ternary copolymer ionomer resins such as Surlyn 8120 (Na), Surlyn 8320 (Na), Surlyn 9320 (Zn), Surlyn 6320 (Mg), HPF 1000 (Mg), and HPF 2000 (Mg)" available from E.I. du Pont de Nemours and Company.

Specific examples of the ionomer resin further include "lotek (registered trademark) (e.g. binary copolymer ionomer resins such as lotek 8000 (Na), lotek 8030 (Na), lotek 7010 (Zn), and lotek 7030 (Zn)); and ternary copolymer ionomer resins such as lotek 7510 (Zn) and lotek 7520 (Zn)" available from ExxonMobil Chemical Corporation.

It is noted that Na, Zn, Li, Mg and the like described in the parentheses after the trade names of the above-described ionomer resins indicate metal types of neutralizing metal ions of the ionomer resins. The ionomer resin may be used alone or as a mixture of at least two of them.

The resin composition preferably contains a thermoplastic polyurethane elastomer or an ionomer resin as the resin component. The amount of the thermoplastic polyurethane or ionomer resin in the resin component of the resin composition is preferably 50 mass % or more, more preferably 60 mass % or more, and even more preferably 70 mass % or more. The resin component of the resin composition may consist of the thermoplastic polyurethane or ionomer resin.

In addition to the resin component, the resin composition may further contain a pigment component such as a white pigment (e.g. titanium oxide), a blue pigment and a red pigment, a weight adjusting agent such as zinc oxide, calcium carbonate and barium sulfate, a dispersant, an antioxidant, an ultraviolet absorber, a light stabilizer, a fluorescent material or fluorescent brightener, as long as they do not impair the performance of the cover.

The amount of the white pigment (e.g. titanium oxide) is preferably 0.5 part or more, more preferably 1 part by mass or more, and even more preferably 1.5 parts by mass or more, and is preferably 10 parts or less, more preferably 8 parts or less, and even more preferably 6 parts by mass or less, with respect to 100 parts by mass of the resin component constituting the cover. If the amount of the white pigment is 0.5 part by mass or more, it is possible to impart the opacity to the cover. In addition, if the amount of the white pigment is 10 parts by mass or less, the durability of the resultant cover is better.

The material hardness of the cover (i.e. the slab hardness of the resin composition constituting the cover) is preferably suitably set in accordance with the desired performance of the golf ball. For example, in case of a so-called distance golf ball which focuses on a flight distance, the material hardness of the cover is preferably 50 or more, more preferably 55 or more, and even more preferably 60 or more in Shore D hardness, and is preferably 80 or less, more preferably 70 or less, and even more preferably 68 or less in shore D hardness. If the material hardness of the cover is 50 or more in Shore D hardness, the obtained golf ball has a higher launch angle and a lower spin rate on driver shots and iron shots, and thus travels a greater distance. In addition, if the material hardness of the cover is 80 or less in Shore D hardness, the obtained golf ball has better durability. Further, in case of a so-called spin golf ball which focuses on controllability, the material hardness of the cover is preferably less than 50, more preferably 48 or less, and even more preferably 45 or less in Shore D hardness, and is preferably 20 or more, more preferably 23 or more, and even more preferably 26 or more in Shore D hardness. If the material hardness of the cover is less than 50 in Shore D hardness, the obtained golf ball more readily stops on the green due to the higher spin rate on approach shots. In addition, if the material hardness of the cover is 20 or more in Shore D hardness, the abrasion resistance is enhanced. In case of a plurality of cover layers, the material hardness of the cover constituting each layer may be identical or different.

Examples of the method for molding the cover include a method which comprises molding the resin composition into a hollow shell, covering the core with a plurality of the hollow shells and performing compression molding (preferably a method which comprises molding the resin composition into a hollow half shell, covering the core with two of the half shells and performing compression molding); and a method which comprises injection molding the resin composition directly onto the core.

When molding the cover in the compression molding method, molding of the half shell can be performed by either a compression molding method or an injection molding method, and the compression molding method is preferred. Compression molding the resin composition into the half shell is carried out, for example, under a pressure of 1 MPa or more and 20 MPa or less at a molding temperature of −20° C. or more and 70° C. or less relative to the flow beginning temperature of the resin composition. By performing the molding under the above conditions, the half shell having a uniform thickness is formed. Examples of the method for molding the cover by using the half shell include a method which comprises covering the core with two of the half shells and then performing compression molding. Compression molding half shells into the cover is carried out, for example, under a molding pressure of 0.5 MPa or more and 25 MPa or less at a molding temperature of −20° C. or more and 70° C. or less relative to the flow beginning temperature of the resin composition. By performing the molding under the above conditions, the cover having a uniform thickness is formed.

In the case of injection molding the resin composition into the cover, the resin composition extruded in a pellet form may be used for injection molding, or the cover materials such as the base resin components and the pigment may be dry blended, followed by directly injection molding the blended material. It is preferred to use upper and lower molds having a hemispherical cavity and pimples for forming the cover, wherein a part of the pimples also serves as a retractable hold pin. When molding the cover by injection molding, the hold pin is protruded to hold the core, the resin composition is charged and then cooled to obtain the cover. For example, the resin composition heated at a temperature ranging from 200° C. to 250° C. is charged into a mold held under a pressure of 9 MPa to 15 MPa for 0.5 to 5 seconds, and after cooling for 10 to 60 seconds, the mold is opened to form the cover.

When molding the cover, concave portions called "dimple" are usually formed on the surface of the cover. The total number of dimples formed on the cover is preferably 200 or more and 500 or less. If the total number of dimples falls with the above range, the size of dimples is more appropriate, and thus the dimple effect is easier to be obtained. The shape (shape in a plan view) of dimples includes, for example, without limitation, a circle, a polygonal shape such as a roughly triangular shape, a roughly quadrangular shape, a roughly pentagonal shape, a roughly hexagonal shape, and other irregular shape. The shape of dimples is employed solely or at least two of them may be used in combination.

The thickness of the cover is preferably 4.0 mm or less, more preferably 3.0 mm or less, and even more preferably 2.0 mm or less. If the thickness of the cover is 4.0 mm or less, the obtained golf ball has better resilience or shot feeling. The thickness of the cover is preferably 0.3 mm or more, more preferably 0.4 mm or more, and even more preferably 0.5 mm or more. If the thickness of the cover is 0.3 mm or more, the cover has enhanced impact durability or wear resistance. In the case that the cover is multiple layered, the total thickness of all the cover layers preferably falls within the above range.

The cover may be single-layered or multiple-layered. It is noted that in the present disclosure, in the case that the cover is multiple-layered, the cover layer disposed between the spherical core and the outermost cover layer is sometimes simply referred to as "intermediate layer".

The golf ball body having the cover formed thereon is ejected from the mold, and is preferably subjected to surface treatments such as deburring, cleaning and sandblast where necessary. In addition, if desired, a paint film or a mark may also be formed. The thickness of the paint film is not particularly limited, and is preferably 5 μm or more, more preferably 6 μm or more, and even more preferably 7 μm or more, and is preferably 50 μm or less, more preferably 40 μm or less, and even more preferably 30 μm or less. If the thickness of the paint film is 5 μm or more, the paint film hardly wears off even if the golf ball is continuously used, and if the thickness of the paint film is 50 μm or less, the dimple effect is more sufficiently obtained and thus the flight performance of the golf ball is enhanced.

The golf ball according to the present disclosure preferably has a diameter in a range from 40 mm to 45 mm. In light of satisfying a regulation of US Golf Association (USGA), the diameter is particularly preferably 42.67 mm or more. In light of prevention of air resistance, the diameter is more preferably 44 mm or less, particularly preferably 42.80 mm or less. In addition, the golf ball preferably has a mass of 40 g or more and 50 g or less. In light of obtaining greater inertia, the mass is more preferably 44 g or more, particularly preferably 45.00 g or more. In light of satisfying a regulation of USGA, the mass is particularly preferably 45.93 g or less.

When the golf ball according to the present disclosure has a diameter in the range from 40 mm to 45 mm, the compression deformation amount of the golf ball (shrinking amount of the golf ball along the compression direction) when applying a load from 98 N as an initial load to 1275 N as a final load to the golf ball is 2.0 mm or more, more preferably 2.2 mm or more, and even more preferably 2.4 mm or more, and is preferably 3.5 mm or less, more preferably 3.3 mm or less, even more preferably 3.1 mm or less, and mostly preferably 2.8 mm or less. If the compression deformation amount is 2.0 mm or more, the golf ball is not excessively hard and has better shot feeling. On the other hand, if the compression deformation amount is 3.5 mm or less, the resilience is higher.

The construction of the golf ball according to the present disclosure is not particularly limited, as long as the golf ball comprises a spherical core and a cover disposed outside the spherical core. The FIGURE is a partially cutaway cross-sectional view showing a golf ball 1 according to one embodiment of the present disclosure. The golf ball 1 comprises a spherical core 2, an intermediate layer 4 covering the spherical core 2, and a cover 3 covering the intermediate layer 4. A plurality of dimples 31 are formed on the surface of the cover. Other portions than the dimples 31 on the surface of the golf ball 1 are lands 32. The golf ball 1 comprises a paint layer and a mark layer on an outer side of the cover 3, but these layers are not depicted.

Examples of the golf ball according to the present disclosure include a two-piece golf ball composed of a spherical core and a single-layered cover covering the spherical core; and a multi-piece golf ball (including a three-piece golf ball) comprising a spherical core, one or more intermediate layer covering the spherical core, and a single-layered cover covering the intermediate layer. The present disclosure can be suitably applied to any one of the above golf balls.

In the preferable embodiment, the golf ball according to the present disclosure comprises a spherical core, one or more intermediate layer and a cover, wherein the surface hardness of the spherical core (Shore C hardness), the surface hardness of the intermediate layer (Shore C hardness) and the surface hardness of the golf ball (Shore C hardness) satisfy a relation of surface hardness of spherical core<surface hardness of intermediate layer>surface hardness of golf ball. If this relation is satisfied, the golf ball has a higher initial velocity on driver shots and a higher spin rate on approach shots. It is noted that in the case that two or more intermediate layers are comprised, the surface hardness of the intermediate layer is a hardness measured on a surface of a sphere having all the intermediate layers formed on the spherical core.

The surface hardness of the intermediate layer is preferably 80 or more, more preferably 85 or more, and even more preferably 90 or more in Shore C hardness, and is preferably 100 or less, more preferably 99 or less, and even more preferably 98 or less in Shore C hardness. If the surface hardness of the intermediate layer falls within the above range, the initial velocity of the golf ball on driver shots is higher. It is noted that the surface hardness of the intermediate layer is the surface hardness of the intermediate layer-covered sphere.

The slab hardness of the intermediate layer is preferably 60 or more, more preferably 62 or more, and even more preferably 64 or more in Shore D hardness, and is preferably 76 or less, more preferably 74 or less, and even more preferably 72 or less in Shore D hardness. If the slab hardness of the intermediate layer falls within the above range, the spin rate of the golf ball on driver shots is suppressed, and the shot feeling is softer.

The thickness of the intermediate layer is preferably 0.8 mm or more, more preferably 0.9 mm or more, and even more preferably 1.0 mm or more, and is preferably 2.0 mm or less, more preferably 1.9 mm or less, and even more preferably 1.8 mm or less. If the thickness of the intermediate layer falls within the above range, the durability is better, and the shot feeling on middle iron shots is softer and better. The surface hardness of the golf ball according to the present disclosure is preferably 50 or more, more preferably 55 or more, and even more preferably 60 or more in Shore C hardness, and is preferably 80 or less, more preferably 75 or less, and even more preferably 70 or less in Shore C hardness. If the surface hardness of the golf ball falls within the above range, the spin rate on approach shots is greater.

EXAMPLES

Next, the present disclosure will be described in detail by way of examples. However, the present disclosure is not limited to the examples described below. Various changes and modifications without departing from the spirit of the present disclosure are included in the scope of the present disclosure.

Evaluation Method (1) Compression Deformation Amount (Mm)

The deformation amount of the core or golf ball along the compression direction (the shrinking amount of the core or golf ball along the compression direction), when applying a load from an initial load of 98 N to a final load of 1275 N to the core or golf ball, was measured.

(2) Slab Hardness (Shore D Hardness)

Sheets with a thickness of about 2 mm were produced by injection molding the intermediate layer composition or cover composition, and stored at a temperature of 23° C. for two weeks. At least three of these sheets were stacked on one another so as not to be affected by the measuring substrate on which the sheets were placed, and the hardness of the stack was measured with a type P1 auto loading durometer available from Kobunshi Keiki Co., Ltd., provided with a Shore D type spring hardness tester prescribed in ASTM-D2240.

(3) Core Hardness Distribution (Shore C Hardness)

The hardness of the core was measured with a type P1 auto loading durometer available from Kobunshi Keiki Co., Ltd., provided with a Shore C type spring hardness tester. The Shore C hardness measured on the surface of the core was adopted as the surface hardness of the core. In addition, the core was cut into two hemispheres to obtain a cut plane, and the hardness at the central point of the cut plane and the hardnesses at the predetermined distances from the central point were measured. It is noted that the hardness of the core was measured at four points at the predetermined distances from the central point of the cut plane, and the average value thereof was calculated.

(4) Surface hardness of intermediate layer and surface hardness of golf ball (Shore C hardness)

The surface hardness was measured with a type P1 auto loading durometer available from Kobunshi Keiki Co., Ltd., provided with a Shore C type spring hardness tester. The Shore C hardness measured on the surface of the intermediate layer-covered sphere having the intermediate layer formed on the spherical core and the Shore C hardness measured on the surface of the golf ball were adopted as the surface hardness of the intermediate layer and the surface hardness of the golf ball, respectively.

(5) Initial velocity, spin rate and flight distance on driver shots

A W #1 driver (trade name: "SRIXON ZX7", loft angle: 10.5°, available from Sumitomo Rubber Industries, Ltd.) was installed on a swing machine available from Golf Laboratories, Inc. The hit point was set at the face center. The golf ball was hit at a head speed of 50 m/sec, and the initial velocity (m/sec) and spin rate (rpm) right after hitting the golf ball, and the flight distance (the distance (m) from the launch point to the stop point) were measured. The measurement was conducted twelve times for each golf ball, and the average value thereof was adopted as the measurement value for that golf ball. It is noted that the spin rate right after hitting the golf ball was measured by continuously taking a sequence of photographs of the hit golf ball. The spin rate, ball initial velocity, and flight distance on driver shots are shown as a difference from those of Golf ball No. 6 in Tables 4 to 6.

(6) Spin Rate on Middle Iron Shots

An I #7 iron (trade name: "SRIXON ZX7", loft angle: 32°, available from Sumitomo Rubber Industries, Ltd.) was installed on a swing machine available from Golf Laboratories, Inc. The hit point was set at the face center. The golf ball was hit at a head speed of 39 m/sec, and the spin rate (rpm) right after hitting the golf ball was measured. The measurement was conducted twelve times for each golf ball, and the average value thereof was adopted as the measurement value for that golf ball. It is noted that the spin rate right after hitting the golf ball was measured by continuously taking a sequence of photographs of the hit golf ball. The spin rate on middle iron shots is shown as a difference from that of Golf ball No. 6 in Tables 4 to 6.

(7) Spin Rate on Approach Shots (Under the Condition that there is Grass Between the Golf Ball and the Club Face)

A sand wedge (trade name: "RTX ZIPCORE", loft angle: 58°, available from Cleveland Golf Inc.) was installed on a swing machine available from Golf Laboratories, Inc. Two leaves (length: about 3 cm) of wild grass were attached to the golf ball that was the testing object, and the golf ball was hit such that there was the wild grass between the club face and the golf ball. The golf ball was hit at a head speed of 16 m/sec, and the spin rate (rpm) right after hitting the golf ball was measured. The measurement was conducted twelve times for each golf ball, and the average value thereof was adopted as the measurement value for that golf ball. It is noted that the spin rate right after hitting the golf ball was measured by continuously taking a sequence of photographs of the hit golf ball. The spin rate on approach shots is shown as a difference from that of Golf ball No. 6 in Tables 4 to 6.

[Production of Golf Ball]

(1) Production of Core

According to the formulations shown in Table 1, the rubber compositions were kneaded with a kneading roll, and molded in upper and lower molds, each having a hemispherical cavity, under the vulcanization conditions shown, in Table 1 to obtain spherical cores having a diameter ranging from 38.9 mm to 39.7 mm. It is noted that the amount of barium sulfate was adjusted such that golf balls had a mass of 45.6 g.

TABLE 2

| Intermediate layer composition | | a | b |
|---|---|---|---|
| Formulation (parts by mass) | Surlyn 8150 | 50 | 25 |
| | Himilan AM7329 | 50 | 50 |
| | Himilan AM1605 | — | 25 |
| | Titanium dioxide | 4 | 4 |
| Slab hardness (Shore D) | | 68 | 67 |

Surlyn (registered trademark) 8150: a sodium ion neutralized ethylene-methacrylic acid copolymer ionomer resin available from Du Pont de Nemours, Inc.

Himilan (registered trademark) AM7329: a zinc ion neutralized ethylene-methacrylic acid copolymer ionomer resin available from Du Pont-Mitsui Polychemicals Co., Ltd.

Himilan AM1605: a sodium ion neutralized ethylene-methacrylic acid copolymer ionomer resin available from Du Pont-Mitsui Polychemicals Co., Ltd.

TABLE 1

| Core No. | | | A | B | C | D | E | F | G | H | I | J | K |
|---|---|---|---|---|---|---|---|---|---|---|---|---|---|
| Rubber composition (parts by mass) | Polybutadiene | | 100 | 100 | 100 | 100 | 100 | 100 | 100 | 100 | 100 | 100 | 100 |
| | Zinc acrylate | | 29.8 | 28.9 | 31.5 | 35.8 | 34.3 | 31.0 | 29.8 | 28.9 | 33.2 | 30 | 29 |
| | Zinc oxide | | 5 | 5 | 10 | 5 | 5 | 5 | 5 | 5 | 10 | 5 | 5 |
| | Barium sulfate | | *1) | *1) | *1) | *1) | *1) | *1) | *1) | *1) | *1) | *1) | *1) |
| | Benzoic acid | | — | — | 2 | — | — | — | — | — | 2 | — | — |
| | Pentabromodiphenyl disulfide | | 0.4 | 0.4 | 0.4 | — | — | 0.4 | 0.4 | 0.4 | 0.4 | 0.4 | 0.4 |
| | Diphenyl disulfide | | — | — | — | 0.4 | 0.4 | — | — | — | — | — | — |
| | Dicumyl peroxide | | 0.7 | 0.7 | 0.7 | 0.7 | 0.7 | 0.7 | 0.7 | 0.7 | 0.7 | 0.7 | 0.7 |
| Vulcanization condition | First step | Temperature (° C.) | 140 | 140 | 155 | 170 | 150 | 160 | 145 | 145 | 170 | 140 | 140 |
| | | Time (minute) | 10 | 10 | 20 | 15 | 20 | 20 | 10 | 10 | 15 | 10 | 10 |
| | Second step | Temperature (° C.) | 155 | 150 | — | — | — | — | 155 | 150 | — | 155 | 155 |
| | | Time (minute) | 10 | 10 | — | — | — | — | 10 | 10 | — | 10 | 10 |
| Diameter (mm) | | | 39.5 | 39.5 | 39.5 | 39.5 | 39.5 | 39.5 | 39.5 | 39.5 | 39.5 | 39.7 | 38.9 |
| Compression deformation amount (mm) | | | 3.24 | 3.18 | 3.20 | 3.24 | 3.18 | 3.18 | 3.20 | 3.15 | 3.20 | 3.21 | 3.34 |

*1) As to an amount of barium sulfate, adjustment was made such that the golf ball had a mass of 45.6 g.

Polybutadiene: "BR730 (high-cis polybutadiene)" available from JSR Corporation

Zinc acrylate: "ZN-DA90S" available from Nisshoku Techno Fine Chemical Co., Ltd.

Zinc oxide: Ginrei R" available from Toho Zinc Co., Ltd.

Barium sulfate: "Barium Sulfate BD" available from Sakai Chemical Industry Co., Ltd.

Benzoic acid: available from Tokyo Chemical Industry Co., Ltd. (purity: at least 98%)

Pentabromodiphenyl disulfide: available from Kawaguchi Chemical Industry Co., Ltd.

Diphenyl disulfide: available from Sumitomo Seika Chemicals Co., Ltd.

Dicumyl peroxide: "Percumyl (registered trademark) D" available from NOF Corporation (2) Preparation of Intermediate Layer Composition and Cover Composition According to the formulations shown in Tables 2 and 3, the materials were mixed with a twin-screw kneading extruder to prepare the intermediate layer composition and the cover compositions in a pellet form. The extruding conditions were a screw diameter of 45 mm, a screw rotational speed of 200 rpm, and a screw L/D=35, and the mixture was heated to 160° C. to 240° C. at the die position of the extruder.

Titanium dioxide: "A-220" available from Ishihara Sangyo Kaisha, Ltd.

TABLE 3

| Cover composition | | c | d |
|---|---|---|---|
| Formulation (parts by mass) | Elastollan NY84A | 100 | — |
| | Elastollan NY82A | — | 100 |
| | Tinuvin 770 | 0.2 | 0.2 |
| | Titanium dioxide | 4 | 4 |
| Slab hardness (Shore D) | | 31 | 29 |

Elastollan (registered trademark) NY84A: thermoplastic polyurethane elastomer available from BASF Japan Ltd.

Elastollan (registered trademark) NY82A: thermoplastic polyurethane elastomer available from BASF Japan Ltd.

Tinuvin (registered trademark) 770: bis(2,2,6,6-tetramethyl-4-piperidyl) sebacate available from BASF Japan Ltd.

Titanium dioxide: "A-220" available from Ishihara Sangyo Kaisha, Ltd.

(3) Production of Golf Ball

The intermediate layer-covered sphere was obtained by injection molding the intermediate layer composition onto the spherical core obtained above. The obtained intermediate layer-covered sphere was charged in a final mold having a plurality of pimples on the cavity surface. Half shells were obtained from the cover composition by the compression molding method. The golf balls having a plurality of dimples with an inverted shape of the pimples on the cavity surface formed on the cover were obtained by covering the intermediate layer-covered sphere charged in the final mold with two of the half shells. The evaluation results of the obtained golf balls are shown in Table 4 to Table 6.

TABLE 4

| Golf ball No. | | | 1 | 2 | 3 | 4 | 5 |
|---|---|---|---|---|---|---|---|
| Core | | Core No. | A | B | C | D | E |
| | Hardness distribution | Center hardness ($H_O$) | 62.8 | 63.3 | 54.8 | 67.8 | 70.7 |
| | | Hardness at 2.5 mm point ($H_{2.5}$) | 70.3 | 69.6 | 62.5 | 72.6 | 71.9 |
| | | Hardness at 5 mm point ($H_5$) | 71.6 | 72.2 | 66.0 | 73.3 | 72.5 |
| | | Hardness at 7.5 mm point ($H_{7.5}$) | 72.4 | 73.1 | 66.8 | 74.1 | 73.0 |
| | | Hardness at 10 mm point ($H_{10}$) | 73.1 | 74.6 | 67.1 | 75.2 | 75.5 |
| | | Hardness at 12.5 mm point ($H_{12.5}$) | 76.8 | 77.1 | 70.7 | 76.0 | 77.1 |
| | | Hardness at 15 mm point ($H_{15}$) | 78.8 | 79.6 | 78.0 | 78.1 | 77.7 |
| | | Surface Hardness ($H_S$) | 82.0 | 81.0 | 83.0 | 84.3 | 79.3 |
| | Hardness relationship | $H_s - H_O$ | 19.2 | 17.7 | 28.2 | 16.5 | 8.6 |
| | | $H_{2.5} - H_0$ | 7.5 | 6.3 | 7.7 | 4.8 | 1.2 |
| | | $H_5 - H_{2.5}$ | 1.3 | 2.6 | 3.5 | 0.7 | 0.6 |
| | | $H_{7.5} - H_5$ | 0.8 | 0.9 | 0.7 | 0.8 | 0.5 |
| | | $H_{10} - H_{7.5}$ | 0.7 | 1.5 | 0.3 | 1.1 | 2.5 |
| | | $H_{12.5} - H_{10}$ | 3.7 | 2.5 | 3.6 | 0.8 | 1.6 |
| | | $H_{15} - H_{12.5}$ | 2.0 | 2.5 | 7.3 | 2.1 | 0.6 |
| | | $H_s - H_{15}$ | 3.2 | 1.4 | 5.0 | 6.2 | 1.6 |
| | | $H_{10} - H_0$ | 10.3 | 11.3 | 12.3 | 7.4 | 4.8 |
| | | $(H_{2.5} - H_0) - (H_{12.5} - H_{10})$ | 3.8 | 3.8 | 4.1 | 4.0 | −0.3 |
| | | $(H_{12.5} - H_{10}) - (H_s - H_{15})$ | 0.5 | 1.1 | −1.4 | −5.4 | 0 |
| | | $(H_{10} - H_0)/(H_s - H_{15})$ | 3.2 | 8.1 | 2.4 | 1.2 | 3.0 |
| | | $(H_{2.5} + H_5 + H_{7.5} + H_{10})/4$ | 71.9 | 72.4 | 65.6 | 73.8 | 73.2 |
| | | $(H_{15} + H_s)/2$ | 80.4 | 80.3 | 80.5 | 81.2 | 78.5 |
| Intermediate layer | | Formulation | a | a | a | a | a |
| | | Thickness (mm) | 1.0 | 1.0 | 1.0 | 1.0 | 1.0 |
| | | Material hardness (Shore D) | 68 | 68 | 68 | 68 | 68 |
| | | Surface hardness (Shore C) | 97 | 97 | 97 | 97 | 97 |
| Cover | | Formulation | c | c | c | c | c |
| | | Thickness (mm) | 0.6 | 0.6 | 0.6 | 0.6 | 0.6 |
| | | Material hardness (Shore D) | 31 | 31 | 31 | 31 | 31 |
| Golf ball | On driver shots | Initial velocity (m/sec) | 0.14 | 0.16 | −0.12 | −0.12 | −0.10 |
| | | Spin rate (rpm) | 20 | 40 | −60 | 110 | 140 |
| | | Flight distance (m) | 0.53 | 0.48 | 0 | −1.70 | −1.90 |
| | | On middle iron shots (spin rate rpm) | 80 | 110 | −140 | 190 | 220 |
| | | On approach shots (spin rate rpm) | 70 | 100 | −80 | 40 | 60 |
| | | Surface hardness (Shore C) | 63 | 63 | 63 | 63 | 63 |
| | | Compression deformation amount (mm) | 2.73 | 2.68 | 2.70 | 2.73 | 2.68 |

Hardness distribution and hardness relationship: Shore C hardness

TABLE 5

| Golf ball No. | | | 6 | 7 | 8 | 9 |
|---|---|---|---|---|---|---|
| Core | | Core No. | F | G | H | I |
| | Hardness distribution | Center hardness ($H_O$) | 64.8 | 63.8 | 64.1 | 55.4 |
| | | Hardness at 2.5 mm point ($H_{2.5}$) | 67.7 | 70.9 | 70.5 | 65.1 |
| | | Hardness at 5 mm point ($H_5$) | 69.7 | 72.2 | 72.4 | 69.6 |
| | | Hardness at 7.5 mm point ($H_{7.5}$) | 70.3 | 72.9 | 73.2 | 70.2 |
| | | Hardness at 10 mm point ($H_{10}$) | 72.0 | 73.3 | 74.9 | 70.6 |
| | | Hardness at 12.5 mm point ($H_{12.5}$) | 74.7 | 77.2 | 77.6 | 71.0 |
| | | Hardness at 15 mm point ($H_{15}$) | 79.3 | 79.2 | 79.8 | 76.7 |
| | | Surface Hardness ($H_S$) | 82.6 | 81.6 | 80.5 | 86.2 |
| | Hardness relationship | $H_s - H_O$ | 17.8 | 17.8 | 16.4 | 30.8 |
| | | $H_{2.5} - H_0$ | 2.9 | 7.1 | 6.4 | 9.7 |
| | | $H_5 - H_{2.5}$ | 2.0 | 1.3 | 1.9 | 4.5 |
| | | $H_{7.5} - H_5$ | 0.6 | 0.7 | 0.8 | 0.6 |
| | | $H_{10} - H_{7.5}$ | 1.7 | 0.4 | 1.7 | 0.4 |
| | | $H_{12.5} - H_{10}$ | 2.7 | 3.9 | 2.7 | 0.4 |
| | | $H_{15} - H_{12.5}$ | 4.6 | 2.0 | 2.2 | 5.6 |
| | | $H_s - H_{15}$ | 3.3 | 2.4 | 0.7 | 9.5 |
| | | $H_{10} - H_0$ | 7.2 | 9.5 | 10.8 | 15.2 |
| | | $(H_{2.5} - H_0) - (H_{12.5} - H_{10})$ | 0.2 | 3.2 | 3.7 | 9.3 |

TABLE 5-continued

| | | Golf ball No. | 6 | 7 | 8 | 9 |
|---|---|---|---|---|---|---|
| | | $(H_{12.5} - H_{10}) - (H_s - H_{15})$ | −0.6 | 1.5 | 2.0 | −9.1 |
| | | $(H_{10} - H_0)/(H_s - H_{15})$ | 2.2 | 4.0 | 15.4 | 1.6 |
| | | $(H_{2.5} + H_5 + H_{7.5} + H_{10})/4$ | 69.9 | 72.3 | 72.8 | 68.9 |
| | | $(H_{15} + H_s)/2$ | 81.0 | 80.4 | 80.2 | 81.4 |
| Intermediate layer | | Formulation | a | a | a | a |
| | | Thickness (mm) | 1.0 | 1.0 | 1.0 | 1.0 |
| | | Material hardness (Shore D) | 68 | 68 | 68 | 68 |
| | | Surface hardness (Shore C) | 97 | 97 | 97 | 97 |
| Cover | | Formulation | c | c | c | c |
| | | Thickness (mm) | 0.6 | 0.6 | 0.6 | 0.6 |
| | | Material hardness (Shore D) | 31 | 31 | 31 | 31 |
| Golf ball | On driver shots | Initial velocity (m/sec) | 0 | 0.11 | 0.14 | −0.14 |
| | | Spin rate (rpm) | 0 | 20 | 35 | −70 |
| | | Flight distance (m) | 0 | 0.4 | 0.42 | 0 |
| | | On middle iron shots (spin rate rpm) | 0 | 50 | 100 | −130 |
| | | On approach shots (spin rate rpm) | 0 | 90 | 120 | −120 |
| | | Surface hardness (Shore C) | 63 | 63 | 63 | 63 |
| | | Compression deformation amount (mm) | 2.68 | 2.70 | 2.65 | 2.70 |

Hardness distribution and hardness relationship: Shore C hardness

TABLE 6

| | | Golf ball No. | 10 | 11 | 12 | 13 |
|---|---|---|---|---|---|---|
| Core | | Core No. | A | J | A | K |
| | Hardness distribution | Center hardness ($H_O$) | 62.8 | 63.0 | 62.8 | 62.3 |
| | | Hardness at 2.5 mm point ($H_{2.5}$) | 70.3 | 70.2 | 70.3 | 70.5 |
| | | Hardness at 5 mm point ($H_5$) | 71.6 | 71.5 | 71.6 | 71.9 |
| | | Hardness at 7.5 mm point ($H_{7.5}$) | 72.4 | 72.2 | 72.4 | 72.6 |
| | | Hardness at 10 mm point ($H_{10}$) | 73.1 | 73.0 | 73.1 | 73.5 |
| | | Hardness at 12.5 mm point ($H_{12.5}$) | 76.8 | 76.8 | 76.8 | 77.2 |
| | | Hardness at 15 mm point ($H_{15}$) | 78.8 | 78.6 | 78.8 | 79.1 |
| | | Surface Hardness ($H_S$) | 82.0 | 82.2 | 82.0 | 81.6 |
| | Hardness relationship | $H_s - H_O$ | 19.2 | 19.2 | 19.2 | 19.3 |
| | | $H_{2.5} - H_0$ | 7.5 | 7.2 | 7.5 | 8.2 |
| | | $H_5 - H_{2.5}$ | 1.3 | 1.3 | 1.3 | 1.4 |
| | | $H_{7.5} - H_5$ | 0.8 | 0.7 | 0.8 | 0.7 |
| | | $H_{10} - H_{7.5}$ | 0.7 | 0.8 | 0.7 | 0.9 |
| | | $H_{12.5} - H_{10}$ | 3.7 | 3.8 | 3.7 | 3.7 |
| | | $H_{15} - H_{12.5}$ | 2.0 | 1.8 | 2.0 | 1.9 |
| | | $H_s - H_{15}$ | 3.2 | 3.6 | 3.2 | 2.5 |
| | | $H_{10} - H_0$ | 10.3 | 10.0 | 10.3 | 11.2 |
| | | $(H_{2.5} - H_0) - (H_{12.5} - H_{10})$ | 3.8 | 3.4 | 3.8 | 4.5 |
| | | $(H_{12.5} - H_{10}) - (H_s - H_{15})$ | 0.5 | 0.2 | 0.5 | 1.2 |
| | | $(H_{10} - H_0)/(H_s - H_{15})$ | 3.2 | 2.8 | 3.2 | 4.5 |
| | | $(H_{2.5} + H_5 + H_{7.5} + H_{10})/4$ | 71.9 | 71.7 | 71.9 | 72.1 |
| | | $(H_{15} + H_s)/2$ | 80.4 | 80.4 | 80.4 | 80.4 |
| Intermediate layer | | Formulation | a | a | b | a |
| | | Thickness (mm) | 1.0 | 1.0 | 1.0 | 1.3 |
| | | Material hardness (Shore D) | 68 | 68 | 67 | 68 |
| | | Surface hardness (Shore C) | 97 | 97 | 96 | 97 |
| Cover | | Formulation | d | c | c | c |
| | | Thickness (mm) | 0.6 | 0.5 | 0.6 | 0.6 |
| | | Material hardness (Shore D) | 29 | 31 | 31 | 31 |
| Golf ball | On driver shots | Initial velocity (m/sec) | 0.13 | 0.17 | 0.11 | 0.15 |
| | | Spin rate (rpm) | 70 | 0 | 50 | 10 |
| | | Flight distance (m) | 0.1 | 0.83 | 0.1 | 0.72 |
| | | On middle iron shots (spin rate rpm) | 170 | 35 | 120 | 45 |
| | | On approach shots (spin rate rpm) | 130 | 20 | 100 | 30 |
| | | Surface hardness (Shore C) | 61 | 63 | 63 | 63 |
| | | Compression deformation amount (mm) | 2.74 | 2.70 | 2.76 | 2.71 |

Hardness distribution and hardness relationship: Shore C hardness

It is apparent from the results shown in Table 4 to Table 6 that the golf ball comprising a spherical core and a cover disposed outside the spherical core, wherein when a center hardness of the spherical core (Shore C hardness), hardnesses at 2.5 mm, 5 mm, 7.5 mm, 10 mm, 12.5 mm and 15 mm points from a center of the spherical core toward a surface of the spherical core (Shore C hardness), and a surface hardness of the spherical core (Shore C hardness) are represented by $H_0$, $H_{2.5}$, $H_5$, $H_{7.5}$, $H_{10}$, $H_{12.5}$, $H_{15}$ and $H_s$ respectively, the following relation is satisfied, each has improved flight distance on driver shots and excellent spin performance on approach shots (particularly under the condition that there is grass between the golf ball and the club face) and on middle iron shots.

$$(H_{2.5}-H_0)>(H_{12.5}-H_{10})>(H_s-H_{15}).$$

The golf ball according to the present disclosure has an improved flight distance on driver shots and excellent spin performance on approach shots (particularly under the condition that there is grass between the golf ball and the club face) and on middle iron shots.

The preferable embodiment 1 according to the present disclosure is a golf ball comprising a spherical core and a cover disposed outside the spherical core, wherein when a center hardness of the spherical core (Shore C hardness), hardnesses at 2.5 mm, 5 mm, 7.5 mm, 10 mm, 12.5 mm and 15 mm points from a center of the spherical core toward a surface of the spherical core (Shore C hardness), and a surface hardness of the spherical core (Shore C hardness) are represented by $H_0$, $H_{2.5}$, $H_5$, $H_{7.5}$, $H_{10}$, $H_{12.5}$, $H_{15}$ and $H_s$ respectively, the following relation is satisfied:

$$(H_{2.5}-H_0)>(H_{12.5}-H_{10})>(H_s-H_{15}).$$

The preferable embodiment 2 according to the present disclosure is the golf ball according to the embodiment 1, wherein relations of $(H_{10}-H_0)>7$ and $(H_s-H_{15})\leq 5$ are satisfied.

The preferable embodiment 3 according to the present disclosure is the golf ball according to the embodiment 1 or 2, wherein relations of $(H_{2.5}+H_5+H_{7.5}+H_{10})/4\geq 70$ and $75\leq(H_{15}+H_s)/2\leq 85$ are satisfied.

The preferable embodiment 4 according to the present disclosure is the golf ball according to any one of the embodiments 1 to 3, wherein a relation of $(H_{2.5}-H_0)\geq 5$ is satisfied.

The preferable embodiment 5 according to the present disclosure is the golf ball according to any one of the embodiments 1 to 4, wherein a relation of 2$ $(H_{12.5}-H_{10})\leq 7$ is satisfied.

The preferable embodiment 6 according to the present disclosure is the golf ball according to any one of the embodiments 1 to 5, wherein a relation of $(H_{2.5}-H_0)-(H_{12.5}-H_{10})\leq 5$ is satisfied.

The preferable embodiment 7 according to the present disclosure is the golf ball according to any one of the embodiments 1 to 6, wherein a relation of $(H_{12.5}-H_{10})-(H_s-H_{15})\leq 5$ is satisfied.

The preferable embodiment 8 according to the present disclosure is the golf ball according to any one of the embodiments 1 to 7, wherein a relation of $(H_{10}-H_0)/(H_s-H_{15})\geq 2$ is satisfied.

The preferable embodiment 9 according to the present disclosure is the golf ball according to any one of the embodiments 1 to 8, wherein a relation of $15\leq(H_s-H_0)\leq 25$ is satisfied.

The preferable embodiment 10 according to the present disclosure is the golf ball according to any one of the embodiments 1 to 9, wherein a relation of $H_0\geq 60$ is satisfied.

The preferable embodiment 11 according to the present disclosure is the golf ball according to any one of the embodiments 1 to 10, wherein relations of $(H_5-H_{2.5})\leq 3$, $(H_{7.5}-H_5)\leq 3$ and $(H_{10}-H_{7.5})\leq 3$ are satisfied.

The preferable embodiment 12 according to the present disclosure is the golf ball according to any one of the embodiments 1 to 11, wherein the golf ball comprises an intermediate layer between the spherical core and the cover, and the surface hardness of the spherical core (Shore C hardness), a surface hardness of the intermediate layer (Shore C hardness) and a surface hardness of the golf ball (Shore C hardness) satisfy a relationship of surface hardness of spherical core<surface hardness of intermediate layer>surface hardness of golf ball.

The preferable embodiment 13 according to the present disclosure is the golf ball according to any one of the embodiments 1 to 12, wherein the golf ball has a compression deformation amount of 2.80 mm or less measured by applying a load from 98 N as an initial load to 1275 N as a final load to the golf ball.

This application is based on Japanese patent applications No. 2022-90976 and 2022-90977 filed on Jun. 3, 2022, the contents of which are hereby incorporated by reference.

The invention claimed is:

1. A golf ball comprising a spherical core and a cover disposed outside the spherical core, wherein when a center hardness of the spherical core (Shore C hardness), hardnesses at 2.5 mm, 5 mm, 7.5 mm, 10 mm, 12.5 mm and 15 mm points from a center of the spherical core toward a surface of the spherical core (Shore C hardness), and a surface hardness of the spherical core (Shore C hardness) are represented by $H_0$, $H_{2.5}$, $H_5$, $H_{7.5}$, $H_{10}$, $H_{12.5}$, $H_{15}$ and $H_s$ respectively, the following relationships are satisfied:

$$H_0\geq 60,\ 80.5\leq H_s\leq 85,\ (H_{2.5}-H_0)>(H_{12.5}-H_{10})>(H_s-H_{15}),\ \text{and}\ (H_{10}-H_0)\geq 9.$$

2. The golf ball according to claim 1, wherein the following relationship is satisfied $0\leq(H_s-H_{15})\leq 5$.

3. The golf ball according to claim 1, wherein the following relationships are satisfied $(H_{2.5}+H_5+H_{7.5}+H_{10})/4\geq 70$ and $75\leq(H_{15}+H_s)/2\leq 85$.

4. The golf ball according to claim 1, wherein the following relationship is satisfied $(H_{2.5}-H_0)\geq 5$.

5. The golf ball according to claim 1, wherein the following relationship is satisfied $2\leq(H_{12.5}-H_{10})\leq 7$.

6. The golf ball according to claim 1, wherein the following relationship is satisfied $(H_{2.5}-H_0)-(H_{12.5}-H_{10})\leq 5$.

7. The golf ball according to claim 1, wherein the following relationship is satisfied $(H_{12.5}-H_{10})-(H_s-H_{15})\leq 5$.

8. The golf ball according to claim 1, wherein the following relationship is satisfied $(H_{10}-H_0)/(H_s-H_{15})\geq 2$.

9. The golf ball according to claim 1, wherein the following relationship is satisfied $15\leq(H_s-H_0)\leq 25$.

10. The golf ball according to claim 1, wherein the following relationship is satisfied $60\leq H_0\leq 72$.

11. The golf ball according to claim 1, wherein the following relationships are satisfied $(H_5-H_{2.5})\leq 3$, $(H_{7.5}-H_s)\leq 3$ and $(H_{10}-H_{7.5})\leq 3$.

12. The golf ball according to claim 1, wherein the golf ball comprises an intermediate layer between the spherical core and the cover, and the surface hardness of the spherical core (Shore C hardness), a surface hardness of the intermediate layer (Shore C hardness) and a surface hardness of the golf ball (Shore C hardness) satisfy the following relationship: (surface hardness of spherical core)<(surface hardness of intermediate layer)>(surface hardness of golf ball).

13. The golf ball according to claim 1, wherein the golf ball has a compression deformation amount of 2.80 mm or less measured by applying a load from 98 N as an initial load to 1275 N as a final load to the golf ball.

14. The golf ball according to claim 12, wherein the surface hardness of the intermediate layer ranges from 80 to 100 in Shore C hardness.

15. The golf ball according to claim 12, wherein the intermediate layer has a slab hardness ranging from 60 to 76 in Shore D hardness.

16. The golf ball according to claim 12, wherein the surface hardness of the golf ball ranges from 50 to 80 in Shore C hardness.

17. A golf ball comprising a spherical core and a cover disposed outside the spherical core, wherein when a center hardness of the spherical core (Shore C hardness), hardnesses at 2.5 mm, 5 mm, 7.5 mm, 10 mm, 12.5 mm and 15 mm points from a center of the spherical core toward a surface of the spherical core (Shore C hardness), and a surface hardness of the spherical core (Shore C hardness) are represented by $H_0$, $H_{2.5}$, $H_5$, $H_{7.5}$, $H_{10}$, $H_{12.5}$, His and $H_s$ respectively, the following relationships are satisfied:

$$H_0 \geq 61, 80.5 \leq H_s \leq 85, (H_{2.5}-H_0) > (H_{12.5}-H_{10}) > (H_s-H_{15}), \text{ and } 15 \leq (H_s-H_0) \leq 20.$$

18. The golf ball according to claim 17, wherein the following relation is satisfied $61 \leq H_0 \leq 70$.

19. A golf ball comprising a spherical core and a cover disposed outside the spherical core, wherein when a center hardness of the spherical core (Shore C hardness), hardnesses at 2.5 mm, 5 mm, 7.5 mm, 10 mm, 12.5 mm and 15 mm points from a center of the spherical core toward a surface of the spherical core (Shore C hardness), and a surface hardness of the spherical core (Shore C hardness) are represented by $H_0$, $H_{2.5}$, $H_5$, $H_{7.5}$, $H_{10}$, $H_{12.5}$, $H_{15}$ and $H_s$ respectively, the following relationships are satisfied:

$$H_0 \geq 60, 80.5 \leq H_s \leq 85, (H_{2.5}-H_0) > (H_{12.5}-H_{10}) > (H_s-H_{15}), \text{ and} (H_{2.5}-H_0) \geq 6.$$

20. The golf ball according to claim 19, wherein the following relation is satisfied $60 \leq H_0 \leq 72$.

* * * * *